US005213447A

United States Patent [19]

Srock

[11] Patent Number: 5,213,447

[45] Date of Patent: May 25, 1993

[54] INTERCONNECTING WATER PLATFORM

[76] Inventor: Bryan J. Srock, 1226 SE. 12th Ave., Deerfield Beach, Fla. 33441

[21] Appl. No.: 607,270

[22] Filed: Oct. 31, 1990

[51] Int. Cl.[5] ..... B63B 35/00

[52] U.S. Cl. ..... 405/219; 405/224; 405/227; 114/266; 114/267

[58] Field of Search ..... 114/263-267; 405/195.1, 203-205, 218-221, 224, 227

[56] References Cited

U.S. PATENT DOCUMENTS

| | | | |
|---|---|---|---|
| 1,900,319 | 3/1933 | Vermeulen | 114/267 X |
| 2,481,821 | 9/1949 | Byrne et al. | 114/266 |
| 2,565,369 | 8/1951 | Hamilton | 114/266 |
| 2,892,433 | 6/1959 | Walker | 114/266 |
| 3,152,568 | 10/1964 | Mayer | 114/266 |
| 3,276,209 | 10/1966 | Mosdell | 114/266 X |
| 3,289,621 | 12/1966 | Sebring | 114/266 |
| 3,492,825 | 2/1970 | Pearson . | |
| 3,691,974 | 9/1972 | Seiford et al. | 114/266 |
| 3,763,808 | 10/1973 | Smith | 114/266 |
| 4,223,629 | 9/1980 | Dunlop | 114/263 |
| 4,287,625 | 9/1981 | Dawson . | |
| 4,386,441 | 6/1983 | Lundholm | 405/220 X |
| 4,493,284 | 1/1985 | Echtler | 114/267 |
| 4,928,616 | 5/1990 | Robishaw et al. | 114/267 |
| 4,928,617 | 5/1990 | Meriwether | 114/267 |

*Primary Examiner*—Randolph A. Reese
*Assistant Examiner*—John Ricci
*Attorney, Agent, or Firm*—Oltman and Flynn

[57] ABSTRACT

An interconnecting water platform composed of a plurality of buoyant units. The buoyant units have digitated interleaved edges for joining the units, and links attached to the sides of the units bridging the edges for interconnecting the units.

7 Claims, 3 Drawing Sheets

INTERCONNECTING WATER PLATFORM

The invention relates to water platforms composed of multiple buoyant units interconnected at interleaved, digitated edges.

BACKGROUND AND PRIOR ART

Floating platforms for use as floating docks, bridges, and any other structures buoyantly supported by water are well known. U.S. Pat. No. 3,492,825, "Portable Boat Dock", and U.S. Pat. No. 4,223,629, "Marine Dock Section", show examples of such structures composed of multiple buoyant units, hingedly interconnected to provide independent movements between individual units. Such platforms suffer from lack of stability and load-carrying ability, since the individual buoyant units lend only limited support to adjacent units.

The floating platforms of the known art also have the drawback that they are composed of differently structured units, so that expansion as need arises is difficult, and can only be accomplished by adding non-standard buoyant units together.

It is accordingly an object of the instant invention to provide an interconnecting water platform that can be constructed of modular buoyant units that can be used to form expandable, changeable platform structures.

It is another object to provide a water platform of modular construction that forms a rigid surface.

SUMMARY OF THE INVENTION

In accordance with the invention there is provided a water platform which includes at least two buoyant platform units wherein each unit has at least one digitated edge for interleavingly matching a digitated edge of another platform unit, and a connecting arrangement for interconnecting the platform units.

According to another feature, there is provided a water platform wherein the platform units are made of buoyant material.

According to still another feature, there is provided a water platform wherein the connecting arrangement includes a plurality of connecting links, wherein each connecting link has opposite ends, and wherein each end is attached to respective adjoining edges of the units.

According to a further feature, there is provided a water platform wherein at least one of the buoyant units has transverse holes connecting opposite sides of the buoyant unit, so that stakes or anchoring bolts can be inserted into the holes for securing the buoyant unit to a sea bottom, or an anchor on the sea bottom can be attached to the platform by means of the anchor bolts.

In order to make the platform rigid there may be provided tie rods disposed between opposite sides of the platform units so that each rod is rigidly attached to each of the platform units, or alternatively the rods may have opposite ends attached to respective connecting links.

Further objects and advantages of this invention will be apparent from the following detailed description of a presently preferred embodiment which is illustrated schematically in the accompanying drawings.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DESCRIPTION OF THE PREFERRED EMBODIMENTS

Figure 1:
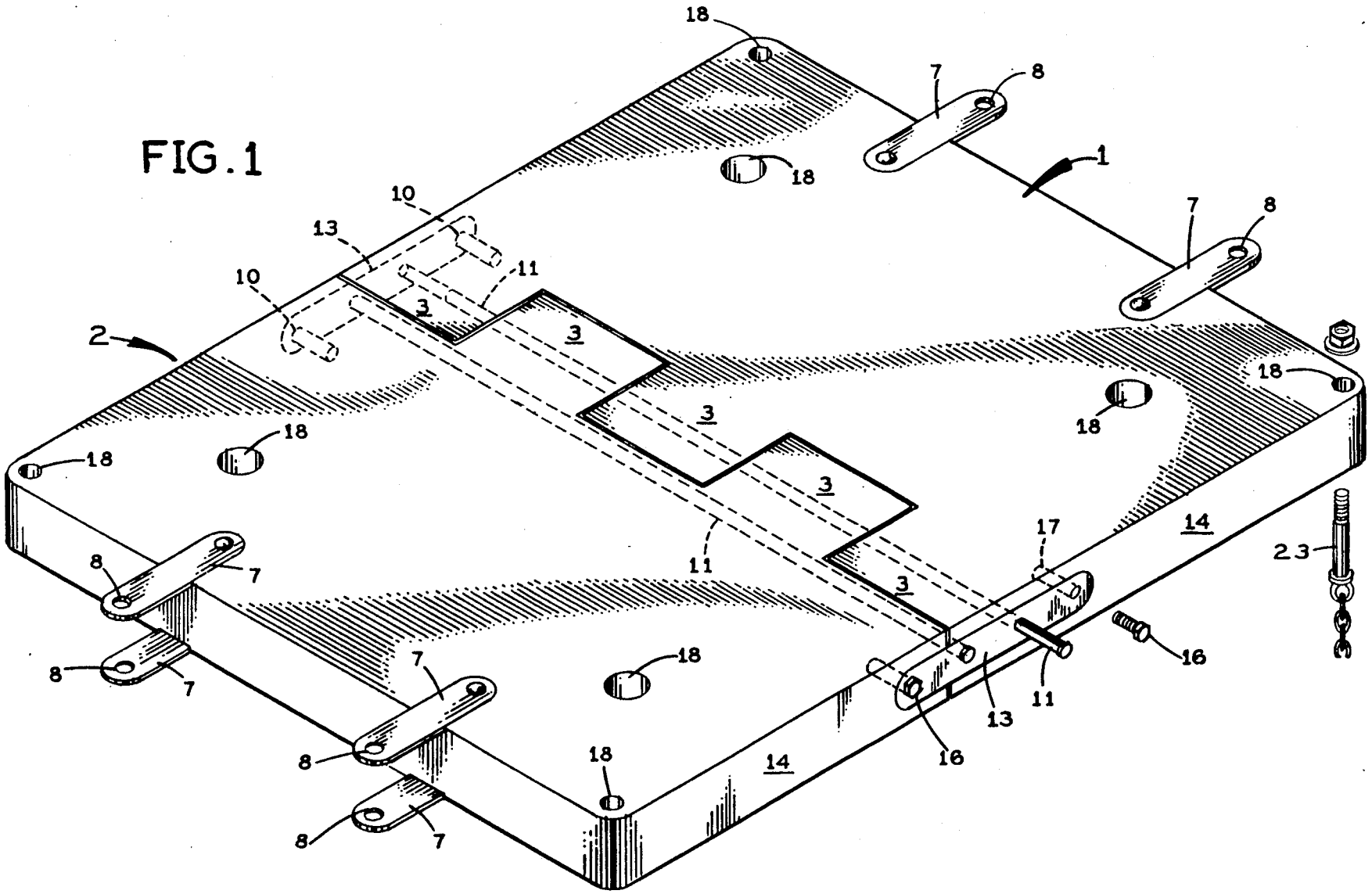
FIG. 1 is a perspective view of the invention showing its major parts.
Figure 4:
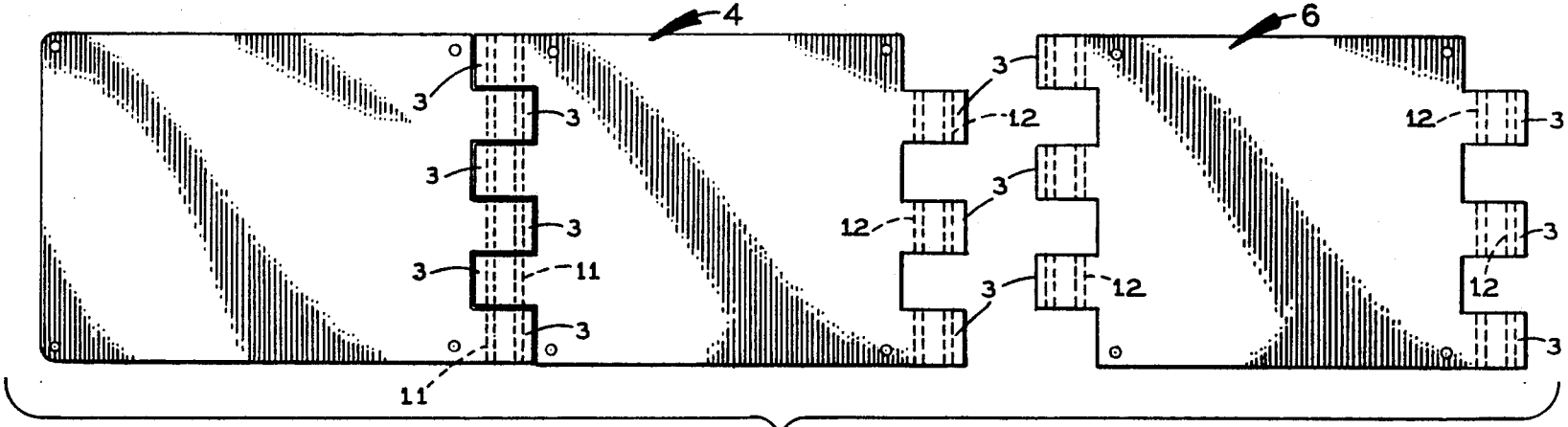
FIG. 4 is a plan of the invention showing three buoyant units partially assembled.

In FIG. 1, a floating platform is composed of two buoyant units 1 and 2, wherein each of the buoyant units has a digitated edge having mutually interleaved extensions 3. The buoyant units 1, 2 are made of any suitable buoyant material, such as wood, structural foam, or any multicellular material that has sufficient buoyancy and strength to support the weight to be carried by the platform. The number of units may be extended without limitation by making more than one side of a unit digitated as shown in FIG. 4, wherein each of the units 4 and 6 has two digitated edges that can be interleaved with the edges of adjacent units. It follows that a unit may be digitated at more than two sides, for example at three sides, or all four sides so that floating platforms of virtually unlimited size and shape can be constructed from buoyant units of a relatively small number of unit shapes.

Figure 5:
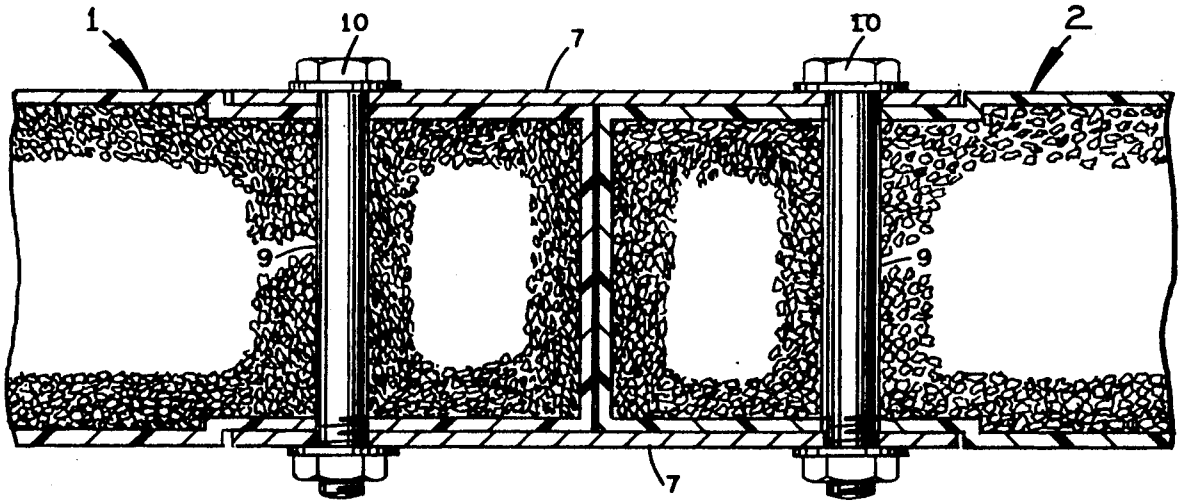
FIG. 5 is a fragmentary enlarged detail of the invention with part of the wall broken away to show the interconnecting details.

The interleaved units may be interconnected by different means to form a rigid platform. FIG. 1 shows connecting links 7 in the form of elongated plates, each having a hole 8 at each end, placed at opposite horizontal surfaces of the units 1, 2 as shown in more detail in FIG. 5, showing two bolts 10 in matching holes 9 interconnecting edges of two units 1, 2 by means of links 7.

Another interconnecting arrangement is based on two or more horizontal rods 11 inserted through horizontal holes 12 through the interleaved extensions 3. Further interconnecting links 13 may be placed on the vertical sides 14 of the units 1, 2, which may also serve to secure the ends of the rods 11 to prevent them from sliding out of the holes 12. The further interconnecting links 13 may advantageously be secured by means of screws or bolts 16 driven or screwed into holes 17 in the sides 14 of the units 1, 2.

Figure 2:
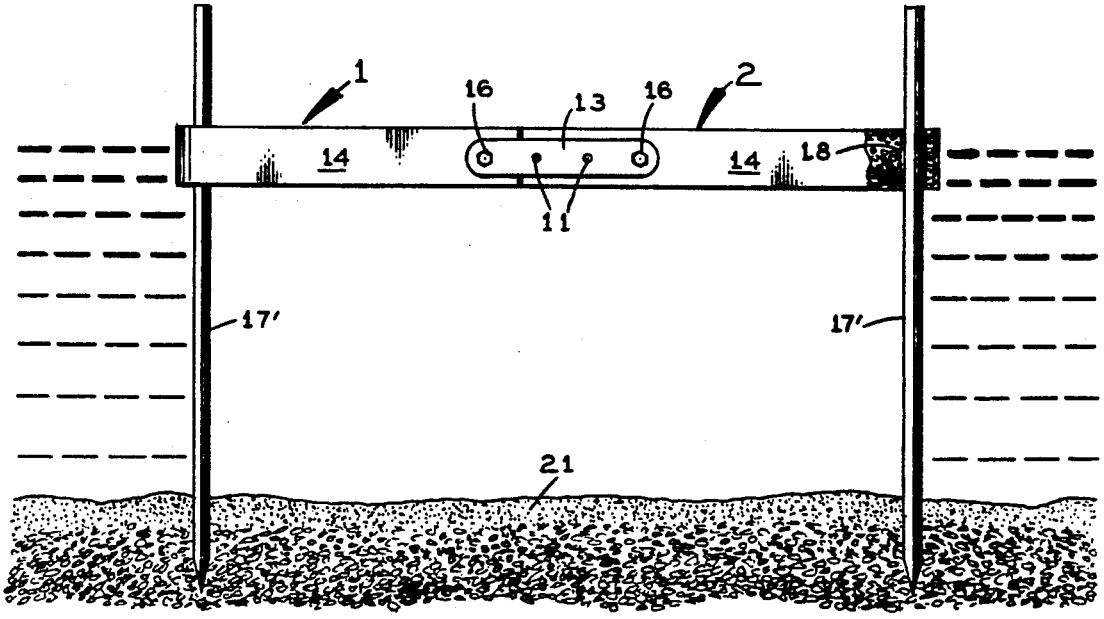
FIG. 2 is an elevational diagrammatic view of the invention showing a floating platform secured by means of stakes in the sea bottom.

The floating platform may be secured in a fixed position on the water by means of vertical stakes 17 inserted through vertical holes 18 through the buoyant units 1, 2, as seen in FIG. 2. The stakes 17 are driven into the sea bottom 21. Alternatively, the units 1, 2 may be secured by means of anchors 19 sunk into the sea bottom 21, and attached by means of chains to eye bolts 23 placed in the transverse vertical holes 18 through the units 1, 2.

Figure 3:
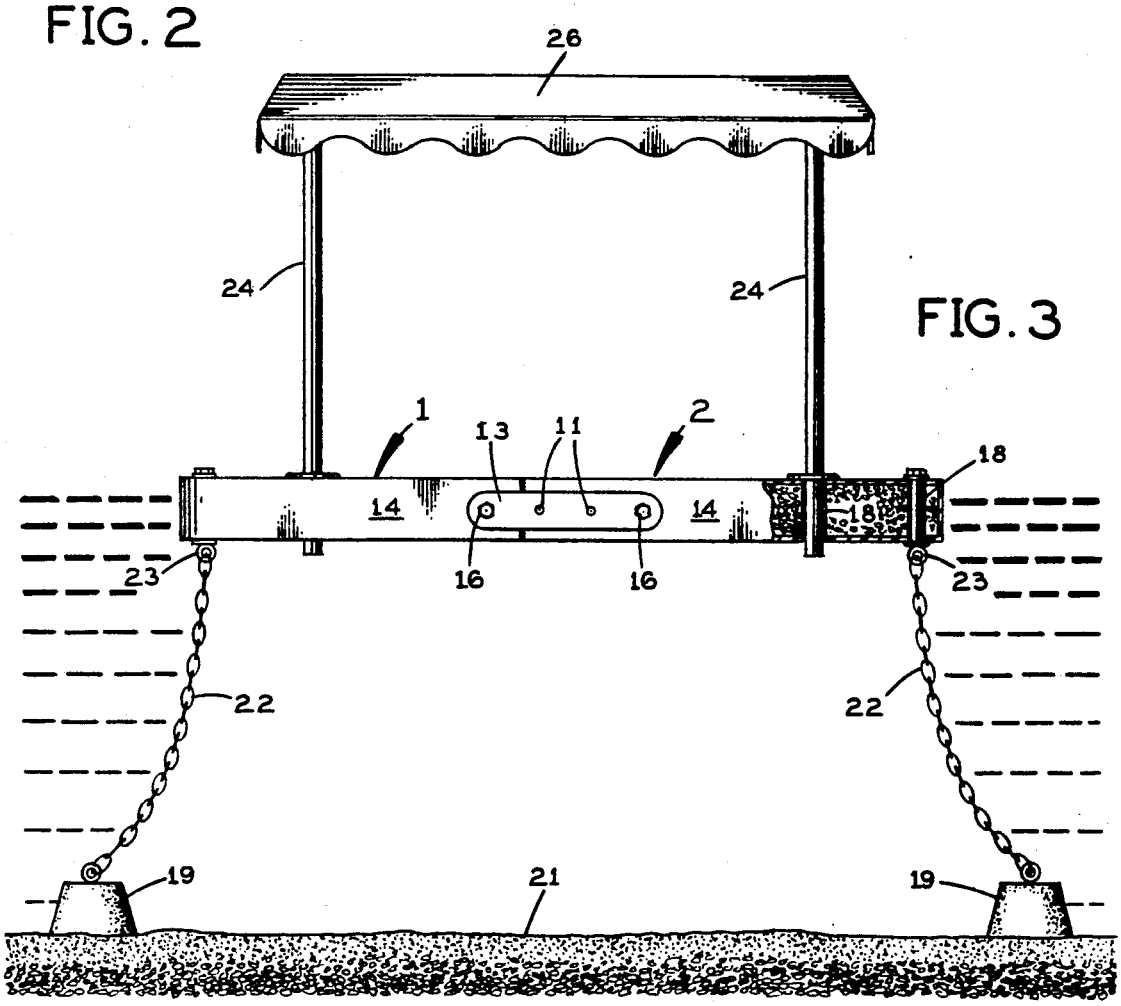
FIG. 3 is an elevational view of the invention showing a floating platform secured by anchors.

The holes 18 can alternatively be used to support vertical posts 24 (FIG. 3) for holding a canopy 26 spread over the floating platform.

I claim:

1. A rigid water platform comprising at least two buoyant units, each buoyant unit having at least one digitated edge for interleavingly matching a digitated edge of another buoyant unit, and rigid interconnecting means for rigidly interconnecting said buoyant units; at least two horizontal rods disposed between opposite vertical sides of said buoyant units, each rod rigidly attached to each of said buoyant units; wherein said digitated edges have interleaved extensions each having at least two horizontal holes coextensive with corresponding holes in adjacent extensions respectively receiving said horizontal rods; and wherein each of said units consists of a single piece of material; and a plurality of elongated connecting plates each having opposite ends each attached to respective adjoining edges of two buoyant units for rigidly interconnecting them.

2. A water platform according to claim 1, wherein said horizontal rods have opposite ends attached to respective connecting plates.

3. A water platform according to claim 1, wherein at least one of said buoyant units has at least one transverse hole connecting opposite sides of said buoyant unit.

4. A water platform according to claim 3, including securing means attached to said transverse hole for securing said buoyant unit to a sea bottom.

5. A water platform according to claim 3, including a vertical post supported in said transverse hole, and a canopy supported by said post.

6. A rigid water platform comprising at least two buoyant units, each buoyant unit having at least one digitated edge for interleavingly matching a digitated edge of another buoyant unit; rigid interconnecting means for rigidly interconnecting said buoyant units, wherein said rigid interconnecting means include a plurality of elongated connecting plates, each connecting plate having opposite ends, wherein each end is attached to respective adjoining edges of two buoyant units; including at least two horizontal rods disposed between opposite vertical sides of said buoyant units, each rod rigidly attached to each of said buoyant units, wherein said digitated edges have interleaved extensions each having at least two horizontal holes coextensive with corresponding holes in adjacent extensions receiving said horizontal rods; and wherein each of said units consists of a single piece of material.

7. A rigid water platform comprising at least two buoyant units, each buoyant unit having at least one digitated edge interleavingly matching a digitated edge of another buoyant unit, said digitated edges having interleaved extensions each having at least two horizontal holes coextensive with corresponding holes in adjacent extensions, and at least two horizontal rods received in said holes and each extending through said adjacent extensions for rigidly interconnecting said buoyant units, each of said buoyant units consisting of a single piece of material, and a plurality of elongated connecting plates each having opposite ends each attached to respective adjoining edges of two buoyant units for rigidly interconnecting said buoyant units.

* * * * *